United States Patent [19]

Laumeister

[11] Patent Number: 4,819,732

[45] Date of Patent: Apr. 11, 1989

[54] FIRE-FIGHTING EQUIPMENT

[75] Inventor: Hugh M. Laumeister, St. Davids, Pa.

[73] Assignee: Uptime Technologies, Inc., New York, N.Y.

[21] Appl. No.: 93,639

[22] Filed: Sep. 8, 1987

[51] Int. Cl.[4] ..... A62C 37/18

[52] U.S. Cl. ..... 169/61; 169/51; 169/11; 169/54

[58] Field of Search ..... 169/43, 46, 49, 51, 169/52, 54, 56, 60, 61, 62, 70, 11, 23, 26, 30, 75

[56] References Cited

U.S. PATENT DOCUMENTS

| | | | |
|---|---|---|---|
| 3,713,491 | 1/1973 | Grabowski et al. | 169/54 X |
| 3,952,808 | 4/1976 | Richardson | 169/61 |
| 4,082,148 | 4/1978 | Willms | 169/61 |
| 4,183,409 | 1/1980 | Iida | 169/26 X |
| 4,351,394 | 9/1982 | Enk | 169/61 |
| 4,691,783 | 9/1987 | Stern et al. | 169/26 X |

*Primary Examiner*—Sherman D. Basinger
*Assistant Examiner*—Paul E. Salmon

[57] ABSTRACT

Cabinet assembly for simple placing in a room so that in the event of a fire it detects fire and discharges compressed fire-fighting vapor such as bromotrifluoromethane. Cabinet contains tank of compressed vapor with discharge conduit and controls so that mere connection to electric power supply will place it in operation. Second tank in cabinet can be arranged to discharge such vapor through opening in raised floor to fight fire in space below the raised floor.

5 Claims, 2 Drawing Sheets

FIRE-FIGHTING EQUIPMENT

SUMMARY

The present invention relates to fire-fighting equipment, particularly such equipment for discharging a fire-extinguishing vapor into a room in which a fire is detected.

Among the objects of the present invention is the provision of novel fire-fighting equipment that is simple to install.

The foregoing, as well as additional objects of the present invention, will be more fully understood from the following description of several of its exemplifications, reference being made to the accompanying drawings in which:

DRAWINGS

FIG. 1 is a perspective view of a fire-fighting assembly representative of the present invention; and FIG. 2 is a perspective view of a different fire-fighting assembly according to the present invention.

DETAILED DESCRIPTION

Figure 1:
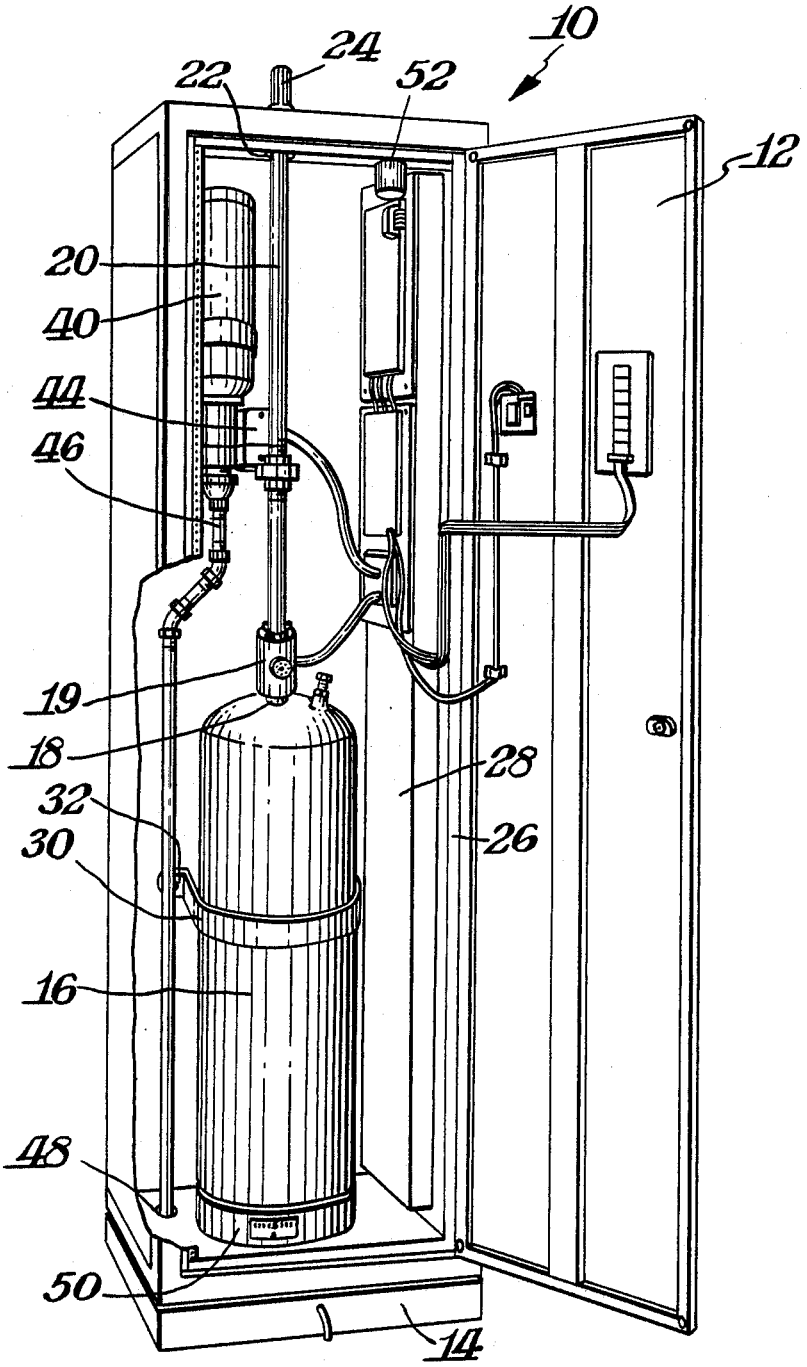

According to the present invention, a self-contained vapor fire-extinguishing assembly has a rectangular cabinet, the base of which is no larger than about two feet by about 3 feet, a tank of compressed fire-extinguishing vapor sufficient to extinguish a substantial fire fitted within the cabinet, a valve-controlled tank discharge conduit extending up through the top of the cabinet, the bottom of the cabinet having an opening site through which a second discharge conduit can be fitted, space within the cabinet for mounting a second tank of compressed fire-extinguishing vapor that can be connected to the second discharge conduit so as to discharge the vapor through the bottom opening site, aural and visual warning means in the cabinet and connected to indicate the operative condition of the assembly, electrically operated triggering means within the cabinet connected to cause the discharge in response to a fire, the triggering means including connectors in the cabinet for connection to fire-detector means, and stand-by battery means within the cabinet connected to energize the system in the event the supply of external electrical power fails.

The cabinet can also contain weighing means connected to weigh a tank and its discharge conduit, and thus indicate when the weight shows that the amount of compressed vapor in the tank is too low.

A fire detector can also be carried by the cabinet and connected to trigger the discharge of the fire-extinguishing agent when a fire is detected.

The present invention is particularly suited for discharging a quantity of bromotrifluoromethane fire-extinguishing vapor, but can be used with other fire-extinguishing vapors.

Turning now to the drawing, the figure shows a rectangular metal cabinet 10, having a hinged door 12 and containing in its interior essentially all the equipment needed to fight a fire. The base 14 of the cabinet is no larger than about two feet by three feet, and it holds a tank 16 of compressed bromotrifluoromethane vapor in a quantity sufficient to safely extinguish a fire in an 1,800-square foot room having a nine-foot ceiling. The cabinet can thus be only about seven feet tall, with about 160 pounds of bromotrifluoromethane vapor in a standard 50-gallon tank.

Tank 16 has at its top a discharge outlet 18 connected through a control valve 19 to a discharge conduit 20 that projects through an opening 22 in the roof of the cabinet and terminates in a standard discharge nozzle 24 above the cabinet. That nozzle preferably has a number of laterally directed discharge openings that project discharged vapor in pre-determined directions so as to rapidly get the vapor into the most effective locations.

Internally mounted on a wall 26 of the cabinet is a rack 28 to which is secured the various relays, controls, transformer, battery and the like, used to operate the apparatus, so that a single connection to an external power supply is all that is needed after the cabinet is placed in the room to be protected. Where an external power line is located in that wall, the power connection to the cabinet is a very simple matter. A fire or smoke detector can also be carried by the cabinet, as for example, on the external face of the door or one of the cabinet walls. Plug-in type junction boxes can be provided on the door or a cabinet wall for plugging in a remote fire or smoke detector. In addition, a manual switch can also be fitted on an outside cabinet face so that the discharges of the fire-fighting vapor can be effected manually.

One or more indicators and or visual as well as aural warning devices can also be mounted on the outside surface of the door or cabinet wall so the operative condition of the equipment is readily noted and any fire warning is easily heard by anyone in the protected room.

The foregoing equipment is readily crated and shipped. After un-crating it need only be placed in the desired location, connected to an external electric power supply, and if desired, have one or more remote fire and/or smoke detectors connected to the cabinet's control unit.

Cabinet 10 can also be fitted with a weighing device, such as a digitally indicating platform-type scale 50 inserted between the bottom of tank 16 and the cabinet floor. Such a scale will show the weight of tank 16, as well as of the discharge structure connected to it. In the event the, tank or its valve 19 leaks, the indicated weight will diminish. When the weight is below a safety limit, the tank should be replaced or repaired and refilled. The scale can have limit switches connected to indicate as by an aural or visual warning when the weight is below that safety limit.

For such weighing, the electric control lines to valve 19 need only be made flexible so they do not prevent vertical tank movement.

The discharge conduit 20 should have clearance all around from the cabinet roof where it passes through that roof, so as not to interfere with the weighing.

If desired, the entire cabinet can be weighed to determine whether there has been an excessive loss of fire-fighting vapor.

For crating shipment, tank 16 can be securely fixed in place as by a strap 30, the ends of which at 32 are bolted to the rear wall of the cabinet. After the cabinet is installed in place, the strap 30 can be relaxed so as to permit the weighing. The weighing device can be separately bolted to the cabinet floor or its walls, and a removable packing pad inserted between the tank and the weighing device.

In the event the room to be protected has a raised floor under which there can be a fire, cabinet 10 can be fitted with a second tank 40 holding a relatively small quantity of compressed fire-fighting vapor. Tank 40 has a valved discharge controller 44 and discharge conduit 46 that penetrates through an opening 48 in the cabinet floor. A hole, not shown, is cut through the raised floor so that discharge conduit 46 projects into the space under the raised floor, to discharge fire-fighting vapor into that space.

A weighing device can be also fitted under tank 40 and secured to a cabinet wall to support that tank, as well as its discharge conduit and valve control. The opening 48 in the cabinet floor and the corresponding opening below in the raised floor should have adequate clearance to permit accurate weighing.

A smaller amount of compressed vapor is needed to extinguish a fire in the space under a raised floor. Tank 40 is, therefore, much smaller than tank 16 and can be of 5-to-10 gallon capacity. The weighing accessories and mounting and securing for both tanks can be very similar. A single control signal can be connected to trigger the discharge of vapor from both tanks, or separate controls can be used to respond to separate fire-sensing detectors to separately actuate the discharge of the tanks.

To protect rooms of 900 square feet, tank 16 can be of 25-gallon size, and tank 40 also quite small, so that cabinet 10 can then be small enough to have a base only about two feet by two feet. For still smaller rooms, the quantity of compressed vapor in the tanks 16 and 40 can be further reduced.

very large rooms can be equipped with two or more of the foregoing cabinet assemblies. Their cabinets can be interconnected so that a single fire-sensing signal will actuate the discharge of the fire-fighting vapor from all cabinets. The cabinets can be positioned close to or adjacent each other, to simplify their interconnections. Two such side-by-side cabinets can thus be used for rooms as large as sixty feet by sixty feet. By way of example, two cabinets can be placed back-to-back in the center of such a large room, or the individual cabinets can be placed adjacent opposite walls of the room, well removed from the corners.

In production, opening 48 in the cabinet floor can be provided even when some of the cabinets are to be used without the upper tank. Alternately, a knock-out partially punched-through opening or simple outline marking can be provided.

The cabinets can be made shorter than seven feet in height and can be as short as three feet, if desired. The cabinets can also be mounted on the wall of a room, as by bolts that pass through mounting openings in the back or a side panel of the cabinet. Such openings can also be prepunched or pre-marked in the cabinet panel.

Figure 2:
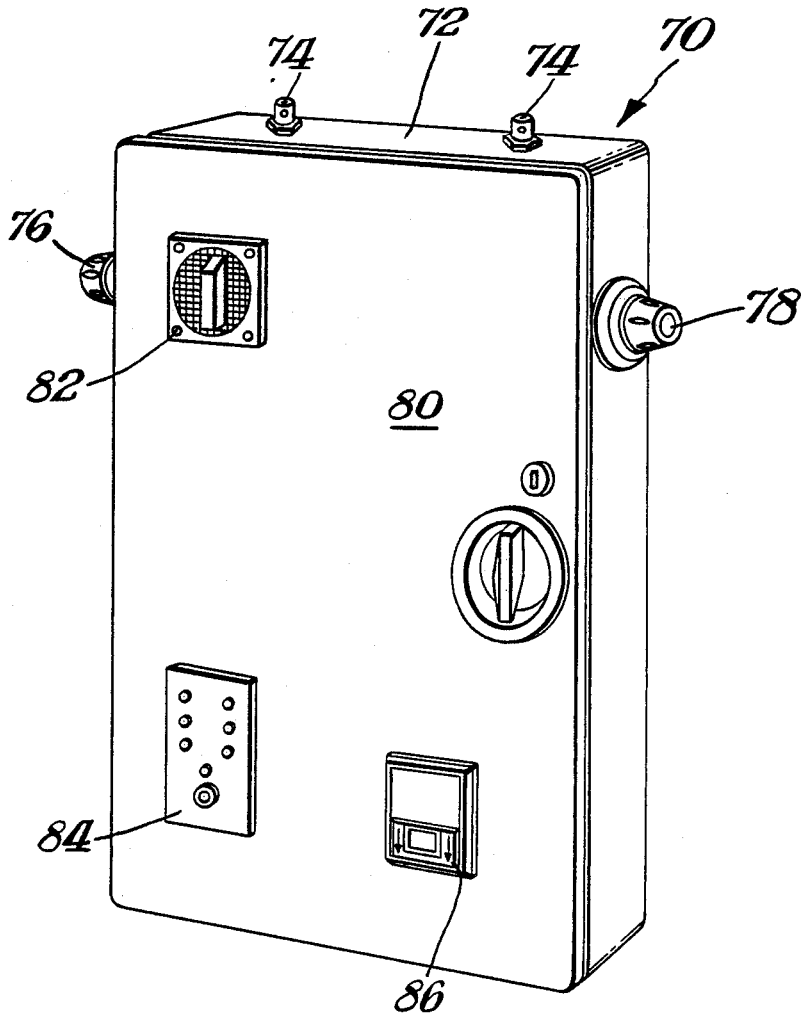

Shorter cabinets are particularly suited for wall mounting. FIG. 2 shows such a wall-mounted cabinet 70. It contains two separate side-by-side tanks of compressed fire-extinguishing vapor, each fitted with a discharge tube that projects through the cabinet's top wall 72 and terminates in a discharge—directing nozzle 74. A cabinet 70 only about two feet wide and about 11 inches deep easily houses enough fire-extinguishing vapor for rooms as large as 500 square feet.

Protruding from the cabinet side walls are a photoelectric smoke detector 76 and an ionization-type fire detector 78. The cabinet includes a door 80 which can be locked and can carry on its outer face a combination strobe light and horn 82, a multi-light status indicator 84, and a manual actuator 86 with actuating instructions, like the floor-mounted cabinet.

The back wall of cabinet 70 can be mounted on a wall of a room adjacent to or directly over a power source. The mounting wall can be partly recessed so that about two to four inches of the cabinet depth is received in the recess and only about 6 to 8 inches of the cabinet depth juts out into the room.

The cabinet assemblies can be made independent of external fire detectors, as by installing in the cabinet a sampling device such as a small centrifugal blower or pump 52 that sucks air from various locations in the room via small diameter plastic tubing and arranges for the sucked-in air to pass through a central fire detector located inside the cabinet. Tubing, having an inside diameter of only about ¼ inch to about ⅜ inch, will be adequate for lengths up to about sixty feet and can very easily be fitted against the wall or ceiling of a room and reach to locations at which fires can be expected to originate. The time for sucked-in air to move through the entire length of tubing should not be over about five seconds.

Pre-punched or pre-marked openings can be provided in the cabinet roof or sides for such tubing penetrations.

Obviously, many modifications and variations of the present invention are possible in the light of the above teachings. It is, therefore, to be understood that within the scope of the appended claims the invention may be practiced otherwise than as specifically described.

I claim:

1. A self-contained vapor fire-extinguishing assembly having a rectangular cabinet, the base of which is no larger than about two feet by about three feet, a tank of compressed fire-extinguishing vapor sufficient to extinguish a substantial fire fitted within the cabinet, a valve-controlled tank discharge conduit extending up through the top of the cabinet, the bottom of the cabinet having an opening site through which a second discharge conduit can be fitted, space within the cabinet for mounting a second tank of compressed fire-extinguishing vapor that can be connected to the second discharge conduit so as to discharge the vapor through the bottom opening site, aural and visual warning means in the cabinet and connected to indicate the operative condition of the assembly, electrically operated triggering means within the cabinet connected to cause the discharge of said compressed vapor through at least one of the discharge conduits in response to a fire, the triggering means including connectors in the cabinet for connection to fire-detector means, and stand-by battery means within the cabinet connected to energize the assembly in the event the supply of external electrical power fails.

2. The combination of claim 1 in which the cabinet also contains weighing means connected to weigh a tank and its discharge conduit and thus indicate when that weight shows that the amount of compressed vapor in the tank is too low.

3. The combination of claim 1 in which the cabinet carries a fire detector.

4. The combination of claim 3 in which the cabinet also carries an air-sampling device connected to suck in air from selected external locations and deliver that sucked-in air to the fire detector.

5.The combination of claim 1 in which the base of the cabinet is no larger than about two feet by two feet.

* * * * *